United States Patent [19]

Schloemann et al.

[11] Patent Number: 4,920,323

[45] Date of Patent: Apr. 24, 1990

[54] MINIATURE CIRCULATORS FOR MONOLITHIC MICROWAVE INTEGRATED CIRCUITS

[75] Inventors: Ernst F. R. A. Schloemann, Weston; Ronald E. Blight, Framingham; Robert L. Mozzi, Lincoln, all of Mass.

[73] Assignee: Raytheon Company, Lexington, Mass.

[21] Appl. No.: 289,895

[22] Filed: Dec. 27, 1988

[51] Int. Cl.[5] ..... H01P 1/387

[52] U.S. Cl. ..... 333/1.1; 333/246

[58] Field of Search ..... 333/1.1, 24.2, 24.1

[56] References Cited

U.S. PATENT DOCUMENTS

| | | | |
|---|---|---|---|
| 3,467,918 | 9/1969 | Dunn et al. | 333/24.2 X |
| 3,522,555 | 8/1970 | Hashimoto et al. | 333/1.1 |
| 3,560,893 | 2/1971 | Wen | 333/24.2 X |

FOREIGN PATENT DOCUMENTS

| | | | |
|---|---|---|---|
| 39610 | 4/1981 | Japan | 333/1.1 |

OTHER PUBLICATIONS

Knerr, R. H. et al., "A Compact Broad-Band Thin--Film Lumped-Element L-Band Circulator", IEEE Transactions on Microwave Theory and Techniques, Dec. 1970, pp. 1100-1107.

Knerr, R. H., "A 4-GHz Lumped-Element Circulator", IEEE Transactions on Microwave Theory and Techniques, Mar. 1973, pp. 150-151.

Knerr, R. H., "An Annotated Bibliography of Microwave Circulators and Isolators: 1968-1975", IEEE Transactions on Microwave Theory and Techniques, vol. MTT-23, No. 10, Oct. 1975, pp. 818-825.

Ogasawara, N. et al., "Coplanar-Guide and Slot-Guide Junction Circulator", Electronics Letters, May 6th, 1971, vol. 7, No. 9, pp. 220-221.

*Primary Examiner*—Paul Gensler

*Attorney, Agent, or Firm*—Denis G. Maloney; Richard M. Sharkansky

[57] ABSTRACT

A miniature circulator which is compatible with integrated circuits is described. The circulator includes a substrate which supports three copolanar waveguide transmission lines which are connected at a common junction. The common junction provides a coupling structure between the coplanar waveguide transmission lines. A ferrite disc having a conductive layer disposed thereover is provided over the intersection of the three coplanar waveguide transmission lines. A magnet is then disposed over the ferrite disc to direct a D.C. magnetic field through the disc. An alternative coupling structure having interwoven, balanced lines disposed on the substrate is also described. An alternative arrangement for the ferrite disc having a hexangular shape, which carries a beam-lead node metalization is also described.

20 Claims, 13 Drawing Sheets

MINIATURE CIRCULATORS FOR MONOLITHIC MICROWAVE INTEGRATED CIRCUITS

BACKGROUND OF THE INVENTION

This invention relates generally to nonreciprocal devices and more particularly to microwave circulators and isolators that are compatible with microwave monolithic integrated circuits.

As it is known in the art, so-called microwave monolithic integrated circuits include active and passive devices which are formed using semiconductor integrated circuit techniques to provide various types of microwave circuits. One such particular application of this technology is in so-called transmit/receive modules (transceiver modules) for use in phased array antennas. In these so-called transceiver modules, active devices such as field effect transistors are combined with passive devices such as capacitors, resistors, inductive elements, and the like to form various microwave functions such as amplifiers and switches. In certain applications, it would be desirable to provide one or more circulators to steer electromagnetic energy through such transceiver modules.

Although non-reciprocal microwave components such as circulators and isolators have been known for many years, no convenient approach is available for combining the circulator function on a common substrate which supports the integrated circuits. Generally, these nonreciprocal components are fabricated separately from the semiconductor components of the transceiver on different substrates.

The nonreciprocal components such as circulators are usually fabricated either on a ferrite substrate or on a dielectric substrate that has a ferrite insert. Both methods of fabrication have the disadvantage of requiring relatively long connecting transmission lines between the integrated circuits and the circulator with associated transmission loss. This hybrid-type approach is also relatively labor intensive and, therefore, costly.

The circulators which are known for use with microwave integrated circuits are usually designed for coupling by means of microstrip transmission lines. An example of a circulator which is well known in the art is shown in FIG. 1. The circulator 10 in FIG. 1 uses a dielectric substrate 12 having a ground plane conductor 14 and a ferrite insert 18. In this design the strip conductors of the microstrip lines **16*a*–16*c* are connected to a metal disc 19 that has approximately the same diameter as the ferrite disc 18. Critical design parameters for this type of circulator are the radius (R) of the metal disc 19 and the coupling angle ($\psi$), which is related to half the angle subtended by each microstrip at the perimeter of the central disc 19. A circulator design similar to one shown in FIG. 1** has the capacity for a very large bandwidth.

Another type of circulator element 25, which is also well known in the art, is shown in FIG. 2. This circulator element 25 is also based on microstrip transmission medium and also uses a ferrite 23 having an "interwoven" coupling structure 25 with port conductors **25*a*–25*c* fabricated on the surface of the ferrite disc 23. Three mask levels are required to fabricate this coupling structure by photolithography (two levels for metalization and one level for a dielectric layer which separates the two layers of metalization). The port conductors on the disc are bonded to corresponding strip conductors 26*a*–26*c*** formed on the substrate.

For a miniature type of circulator, one could insert circulator element 25 into a dielectric substrate 22 having a ground plane conductor 24, as shown. A hole 27 must be provided in such a dielectric 22.

The advantage of a circulator design such as illustrated in FIG. 2 is that it would achieve significant size reduction compared to the design shown in FIG. 1. The circulator illustrated in FIG. 2 includes capacitor pads **29*a*–29*c* disposed on the surface of the dielectric substrate at the terminus of the strip conductors 26*a*–26*c*, and a capacitor 28 provided by a metal layer 28*a* disposed on the bottom surface of ferrite 23, dielectric 28*b*, disposed thereover and a second metal layer 28*c* which acts as a ground plane conductor disposed on the dielectric 28*b*. The size of the capacitor pads 29*a*–29*c* depends upon the frequency of operation with lower frequencies requiring relatively large capacitor pads. The capacitor is disposed on the bottom of the ferrite disc 23 to capacitively couple the node metalization 28*a* to the ground plane conductor. The capacitances of the capacitors formed over the ferrite 28 and strip conductors 26*a*–26*c* are adjusted to achieve optimum performance. Theoretical calculations concerning the design of the circulator element 25 (FIG. 2) and actual performance data for the element 25** have been reported by R. Knerr, IEEE Transactions MTT-18, pp. 1100–1108, Dec. 1970.

Therefore, although circulators are known to be fabricated on dielectric substrates, the problems with the design illustrated in FIGS. 1 and 2 are that each circulator requires a hole to be drilled into the dielectric substrate to receive the ferrite disc. This requirement makes this general approach to integrating circulators with semiconductor circuits comparatively costly. The hole requirement also presents a very difficult fabrication problem particularly when the circulators are selected to be fabricated on brittle dielectric substrates such as gallium arsenide, the generally preferred material for monolithic microwave integrated circuits. Since gallium arsenide is a relatively brittle material, fabrication of the hole in gallium arsenide is not a trivial process step.

Further, each of these approaches requires that the coupling structure, as well as capacitors, be fabricated on or under the ferrite disc. This is also a difficult processing step.

Fabrication difficulties can be avoided with these techniques by simply using a substrate without a hole and placing the ferrite disc with the coupling structure on top of the junction and thus, otherwise retain a structure as shown in FIGS. 1 or 2. It has been shown, however, that this technique does not lead to circulators with useful performance, since the electromagnetic field does not penetrate sufficiently into the ferrite but remains concentrated in the dielectric substrate.

Summary of the Invention

In accordance with the present invention, a nonreciprocal magnetic device such as a circulator which is suitable for integration with monolithic microwave integrated circuits includes a semiconductor or dielectric substrate having disposed over a major surface thereof a ground plane conductor. The ground plane conductor is patterned to provide exposed regions of said major surface of said substrate within which are provided strip conductors dielectrically spaced from the ground plane conductor to form in combination with the ground plane conductor a coplanar waveguide transmission medium. The strip conductor has first ends which provide in/out ports of the circulator and second ends which are terminated at a common, central node metalization which is disposed in a central exposed region of said substrate, dielectrically spaced from said ground plane conductor. With this particular arrangement, a simple circulator operating in coplanar waveguide transmission media is provided. The ferrite disc is disposed directly over the central node metalization, and the coupling structure is disposed on the substrate surface. This approach eliminates the need for a hole in the substrate to accommodate the ferrite disc while keeping the electromagnetic field concentrated in the ferrite rather than the dielectric. Further, since the coupling structure is provided over the dielectric, this structure is easier to fabricate than prior approaches where the coupling structure is fabricated over the disc.

In accordance with a preferred aspect of the invention, the central node metalization is disposed over a surface of the ferrite and an interwoven coupling structure is provided in the central exposed region of said substrate. Each of the strip conductors of the coplanar waveguide transmission lines includes a pair of spaced strip conductor portions, each having a first end connected to the respective strip conductor and a second end terminated at the ground plane conductor. These spaced strip conductor portions are disposed over the central exposed region of the substrate, and a first spaced strip conductor portion of one of the strip conductors is interlaced with each of the spaced strip conductor portions of the remaining strip conductors, to provide a balanced coupling structure for the circulator. The ferrite disc having the central node metalization is then disposed over the coupling structure provided on the dielectric substrate. Means are provided to couple the common node metalization to the ground plane conductor. With this particular arrangement, by providing an interwoven coupling structure on the substrate and providing the ferrite disc over the interwoven coupling structure, a circulator is provided which may be easily integrated with semiconductor circuits such as in a phased array antenna module, without the necessity of drilling a hole through the substrate as generally required in prior techniques. Moreover, the interlaced coupling structure is more easily fabricated on the substrate rather than the ferrite, thus improving the yield and manufacturability of said circuits, while providing a circulator having balanced and equal coupling between the ports thereof. Further, by providing a ground plane conductor and strip conductors on a common surface of the substrate, the attendant concentration of the electromagnetic field in the substrate encountered when simply placing a ferrite disc over the substrate is eliminated since the electromagnetic field does not significantly penetrate through the dielectric substrate.

Preferably, the ferrite disc has a hexangular shape and includes a beam leaded coupling structure disposed over a first surface thereof. With this arrangement, a hexangular-shaped ferrite disc is simpler to fabricate than a circular disc particularly on a mass-production basis.

In accordance with a further aspect of the present invention, the circulator further includes a controlled node to ground capacitor disposed about the periphery of the junction formed between the ports of the circulator. The controlled node to ground capacitor is provided by interposing a layer of dielectric between the ground plane conductor formed on the surface of the substrate and a narrow metal layer disposed around the periphery of the junction provided by the ports of the circulator. The narrow peripheral metal layer is disposed over the ground plane conductor, and spaced therefrom by the dielectric, thus providing a capacitor disposed about the periphery of the junction. The metal layer is isolated from the port conductors of each strip transmission line by the dielectric. The second ends of each strip conductor portion are terminated at the peripheral metal layer. With this particular arrangement, a controlled peripheral node to ground capacitor is provided which capacitively couples the interlaced strip conductor portions to the ground plane. This capacitance may be selected to optimize bandwidth and other performance characteristics of the circulator. The peripheral node to ground capacitance is also easier to fabricate than the techniques of capacitively coupling the bottom of a ferrite disc to a ground plane as in prior approaches.

BRIEF DESCRIPTION OF THE DRAWINGS

The foregoing features of this invention, as well as the invention itself, may be more fully understood from the following detailed description of the drawings, in which:

FIGS. 9A–11A are a series of plan views showing steps in constructing a coupling structure over a substrate in accordance with a preferred aspect of the present invention;

FIGS. 9B–11B are cross-sectional views taken along lines 9B—9B of FIG. 9A, 10B—10B of FIG. 10A, and 11B—11B of FIG. 11A;

Description of the Preferred Embodiments

Figure 3:
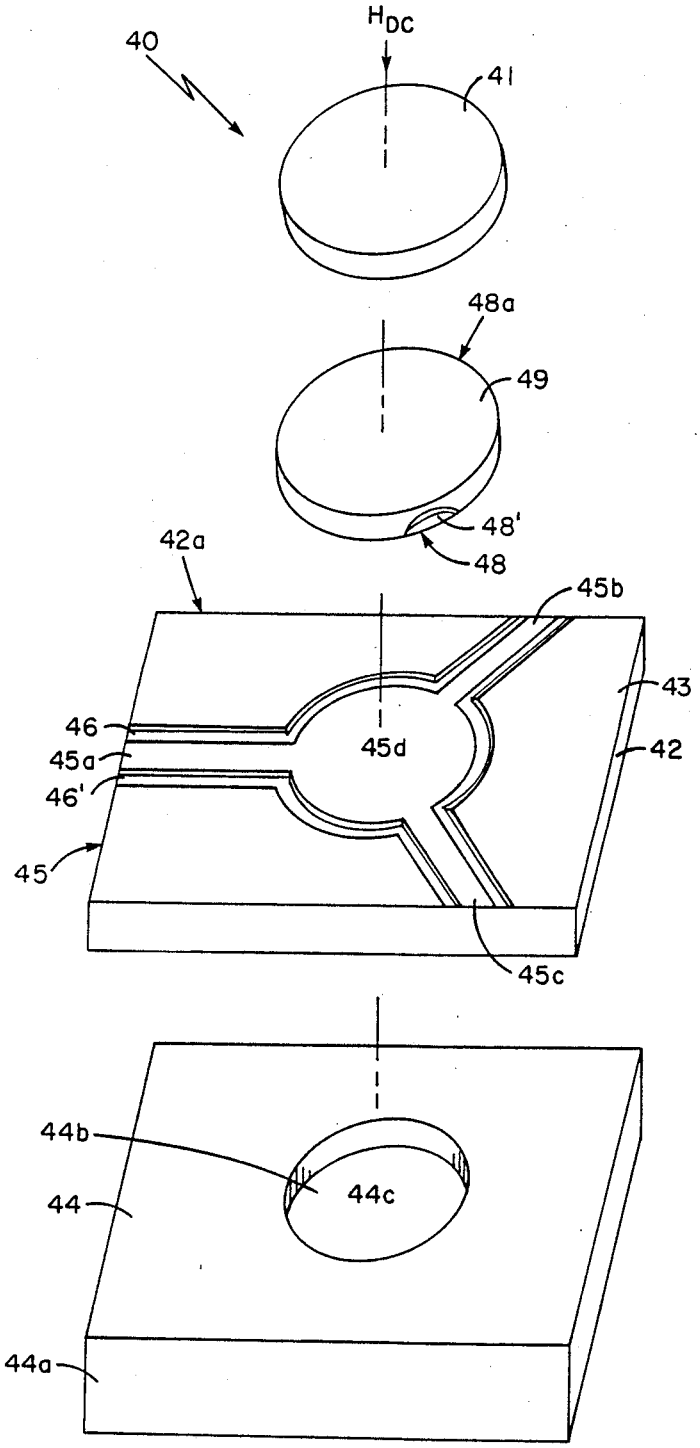
FIG. 3 is a composite, isometric view of a coplanar waveguide circulator having a ferrite disc disposed on a surface of the substrate.

Referring now to FIG. 3, a circulator 40 having a coplanar waveguide transmission medium 45 is shown to include a substrate 42 comprised of a dielectric material such as aluminum oxide or as here a semiconductor material such as gallium arsenide or other suitable III–V or a Group IV material which has suitable dielectric or insulating properties. Disposed over a first major surface 42*a* of substrate 42 is a ground plane conductor 43 patterned to provide exposed portions of said substrate surface 42*a*. Disposed on the exposed portions of said surface 42*a* is a patterned strip conductor 45 having branched strip conductors portions 45*a*–45*c* which connect to a common central strip portion 45*d*, with said branched portions 45*a*–45*c* and common central portion 45*d* being disposed on the same surface of substrate 42 as the ground plane conductor 43 and dielectrically spaced from the ground plane conductor 43 by channels 46 and 46′, here the widths of said channels 46 and 46′ being substantially equal and are selected in accordance with the width of the strip conductors 45*a*–45*c* to provide a coplanar waveguide transmission media having a selected characteristic impedance.

A ferrite disc 48 comprised of a ferrimagnetic material preferably a ferrite such as a lithium ferrite or a garnet such as yttrium iron garnet has a conductor 49 disposed over an upper surface of the ferrite disc 48, a lower surface of the ferrite disc 48, and side surfaces of the ferrite disc 48, as shown. The conductor 49 is not present in selected regions 48′ of the ferrite disc 48 which come into contact with the strip conductor portions 45*a*–45*c*, as shown. The ferrite disc 48 is thus disposed over central strip conductor portion 45*d* and is attached to substrate 42 by conventional techniques such as soldering or bonding with a conductive epoxy. Disposed over the ferrite disc 48 is a magnet 41 which provides a magnetic field $H_{DC}$ through the ferrite disc in a direction normal to the major surfaces 48*a* of disc 48. The strength of the magnetic field $H_{DC}$ is selected to bias the ferrite close to ferromagnetic resonance. Disposed under the substrate 42 is a ground plane block or base 44*a* having a ground plane conductor 44 and an optionally recessed hole 44*b*. The base or the ground plane block 44*a* is formed of a conductive material such as brass, which may be plated with a highly conductive metal such as gold. The recess ground plane 44*b* is optionally provided on the device to further remove the ground plane from the underlying regions of the ferrite and to thus further concentrate the electromagnetic fields in the ferrite rather than the dielectric substrate when signals are applied to the circulators. This will provide improvements in performance of the circulator by lowering insertion loss and increasing isolation.

Figure 1:
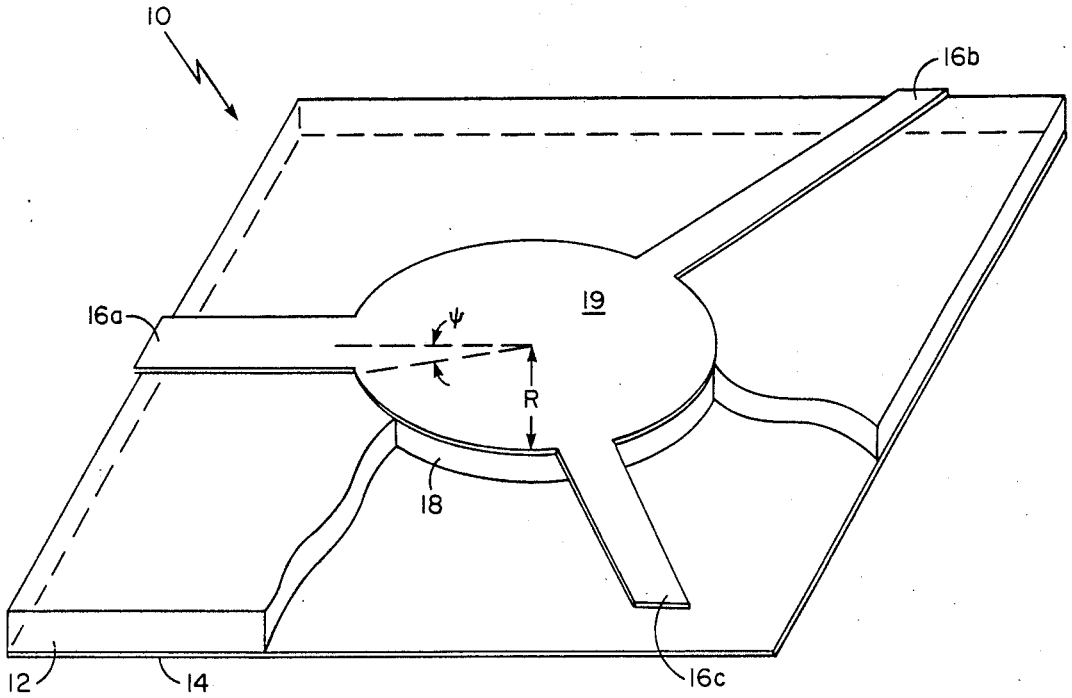
FIG. 1 (PRIOR ART)
FIG. 1 is an isometric view of a conventional microstrip transmission line circulator using a dielectric substrate having a ferrite inserted within a hole disposed in the dielectric substrate.
Figure 2:
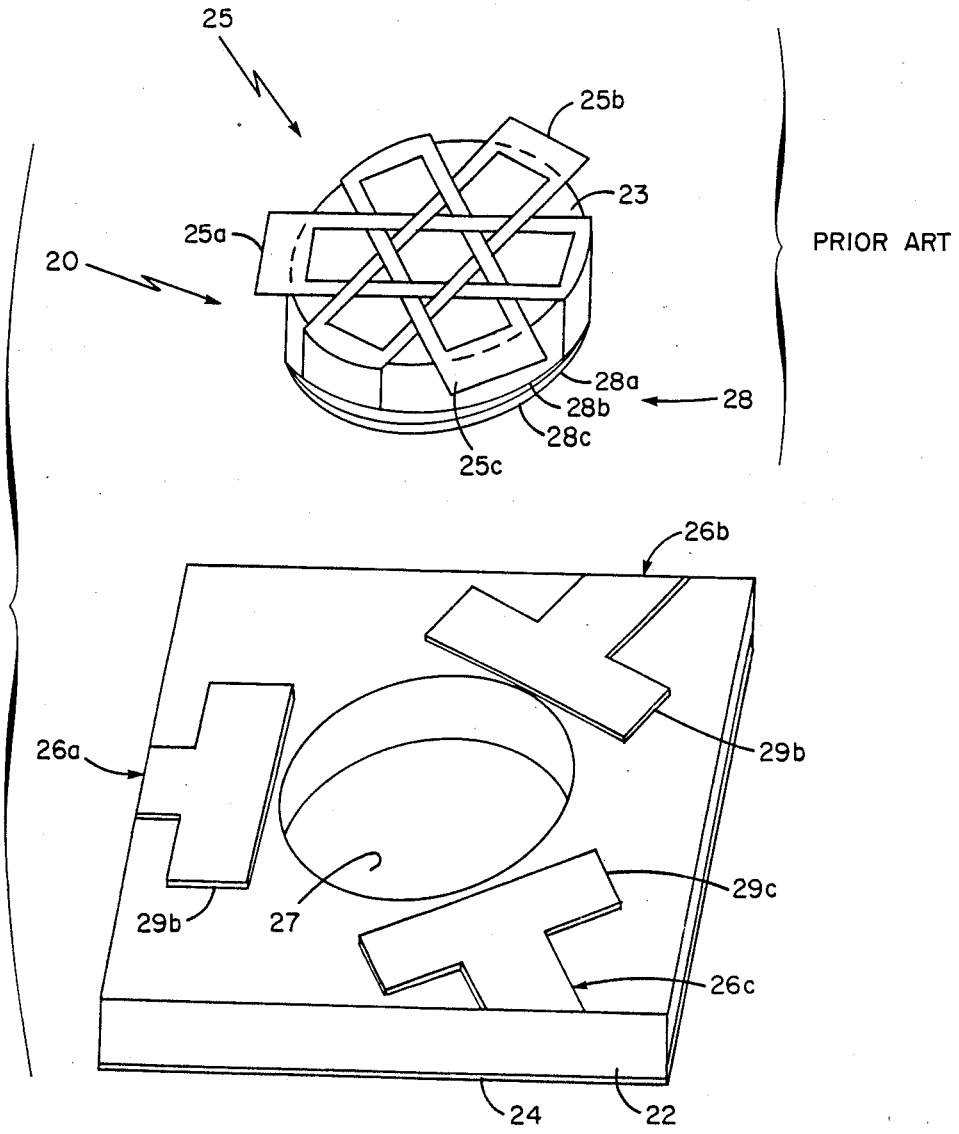
FIG. 2 is an isometric view of a proposed miniature circulator using a microstrip transmission medium with a ferrite having a conventional interlaced coupling structure.
Figure 3A:
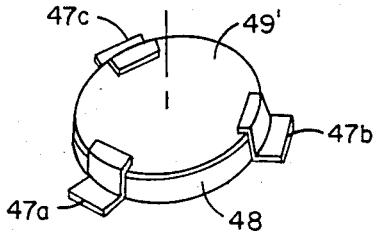
FIG. 3A is an isometric view of an alternate embodiment for a ferrite member for use in the circulator of FIG. 3.

The circulator as shown in FIG. 3, accordingly, has a surface mounted ferrite disc 48 which alleviates the necessitity of forming or drilling a hole through the dielectric substrate 42 as generally required with the prior art approaches shown in conjunction with FIGS. 1 and 2. Further, the electromagnetic energy fed to the circulator is concentrated primarily in the ferrite disc 48 rather than substrate 42, since the principal ground plane conductor is disposed on the same surface as the strip conductor. Further, the optionally recessed ground plane conductor will further improve performance by minimizing the amount of the electromagnetic field concentrated in the dielectric 42. Alternatively, ferrite disc 48 may have a conductive coating 49′ over an upper surface which has beam leads 47*a*–47*c*, as shown in FIG. 3A to couple to ground plane conductor 43 in FIG. 3.

Figure 4:
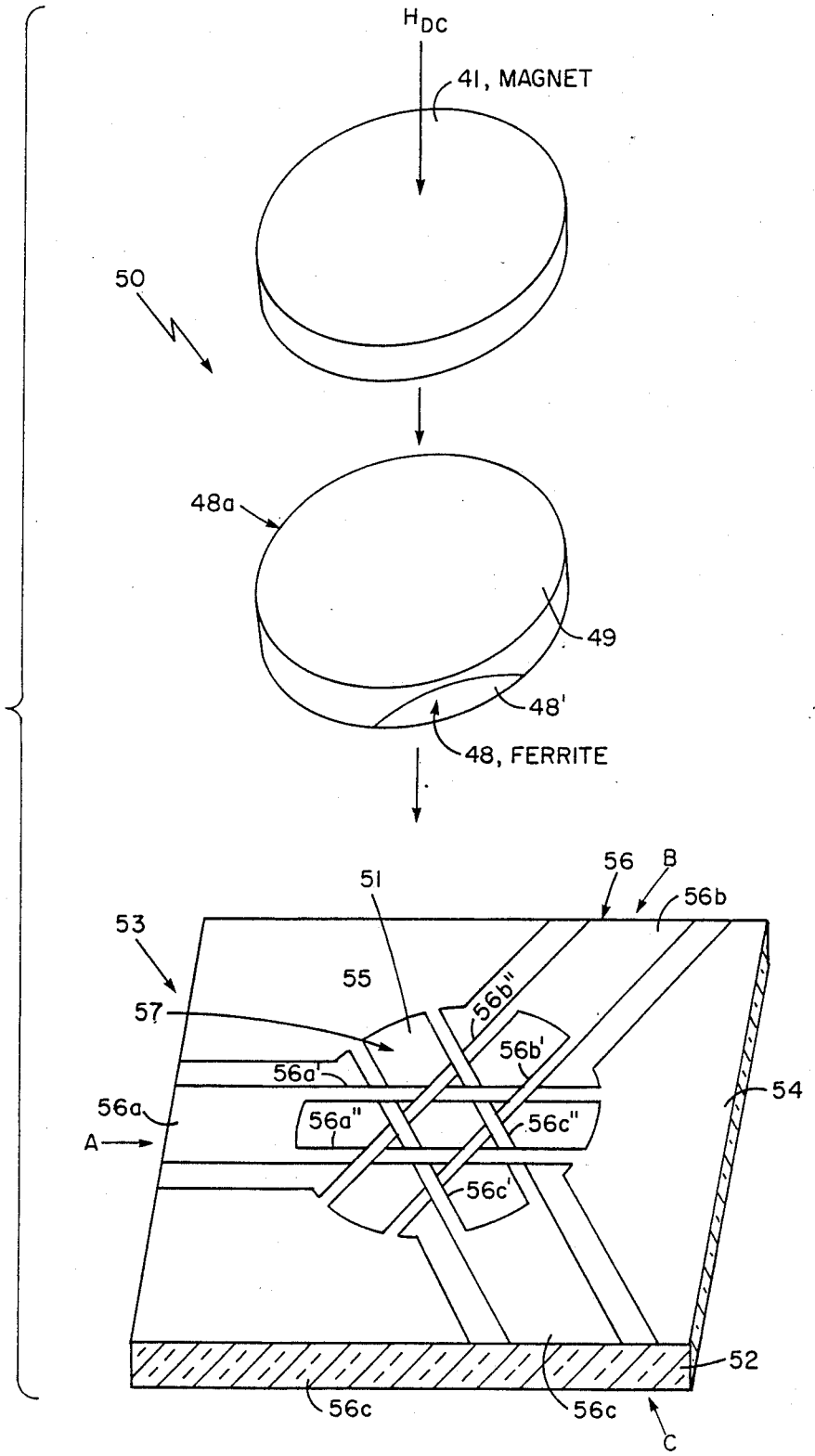
FIG. 4 is an isometric view of a preferred embodiment of a coplanar waveguide circulator having an interwoven coupling structure.

For improved performance in a circulator of the type shown in FIG. 3 particularly when bandwidth and size are considered, the device as shown in FIG. 4 may be preferable.

Referring now to FIG. 4, a circulator 50 having a coplanar waveguide transmission media 53 which includes a coplanar waveguide ground plane conductor 54 disposed over a first surface of the substrate 52 and a patterned strip conductor 56 having strip conductor branches 56*a*–56*c*, as shown, disposed and dielectrically isolated from the ground plane conductor 54, is shown. Here the strip conductor branches 56*a*–56*b* have narrow strip conductor portions 56*a*′, 56*a*″ to 56*c*′, 56*c*″, respectively, connected at respective first ends of said strip conductors 56*a*–56*c* and terminated at the coplanar waveguide ground plane conductor 54 in a region thereof opposite to the strip conductors 56*a*–56*c*. In order to provide the circulator with symmetrical operation between ports A-B, B-C, and C-A of the device shown in FIG. 4, the strip conductor segments 56*a*′, 56*a*″ to 56*c*′, 56*c*″ are interwoven or interlaced over an exposed central region 51 of the substrate 52 to provide an interwoven coupling structure 57 as will be described in conjunction with FIG. 4A. The circulator 50 further includes a ferrite disc 48 of the type described in conjunction with FIG. 3 having a conductive layer 49 as also described in conjunction with FIG. 3 disposed on the interwoven coupling structure and a magnet 41 disposed over said ferrite disc 48 in a manner as generally discussed in conjunction with FIG. 3, such that the magnetic field $H_{DC}$ is directed through the ferrite disc 48 in a direction normal to surface 48*a* of disc 48. The disc 48 having coating 49′ as shown in FIG. 3A may alternatively be used.

Figure 4A:
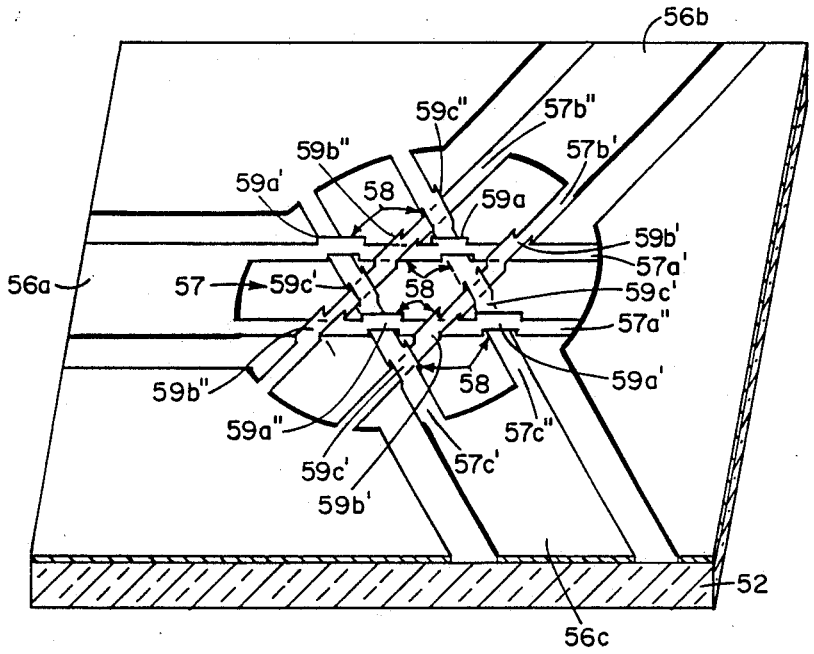
FIG. 4A is a blown-up view of the substrate shown in FIG. 4, detailing the crossovers and interwoven coupling structure of the device shown in FIG. 4.

Referring now to FIG. 4A, the dielectric or semiconductor substrate 52 has patterned thereover, the interwoven coupling structure 57. The interwoven coupling structure 57 is comprised of a first layer of metal, which is patterned to provide multiple, spaced strip conductor portions 57*a*′, 57*a*″ to 57*c*′, 57*c*″ disposed on substrate 52, as shown. A layer of dielectric (not shown) is disposed over the first layer of metal and is patterned to provide patches 58 (location shown) which mask selected underlying portions of strip conductor portions 57*a*′, 57*a*″–57*c*′, 57*c*″. A second metal layer is disposed over the dielectric patches 58 and is patterned to provide strip conductor portions 59*a*′, 59*a*″–59*c*′, 59*c*″ which are disposed to interconnect or bridge corresponding strip conductor portions 57*a*′, 57*a*″–57*c*′, 57*c*″ to provide in combination the strip conductor portions 56*a*′, 56*a*″; 56*b*′, 56*b*″; and 56*c*′, 56*c*″ respectively, as shown in FIG. 4. With this arrangement, as shown in FIG. 4, each strip conductor portion, for example, here strip conductor portion 56a' of strip conductor 56a is interwoven with each one of the strip conductor portions 56b', 56b'' and 56c', 56c'' of the other strip conductors 56b and 56c. By interweaving each strip conductor portion, this arrangement provides balanced and symmetrical coupling between adjacent ports and provides a completely balanced circulator. Other airbridge overlay techniques which are well known in the semiconductor art may also be used to form the interwoven coupling structure.

Figure 5:
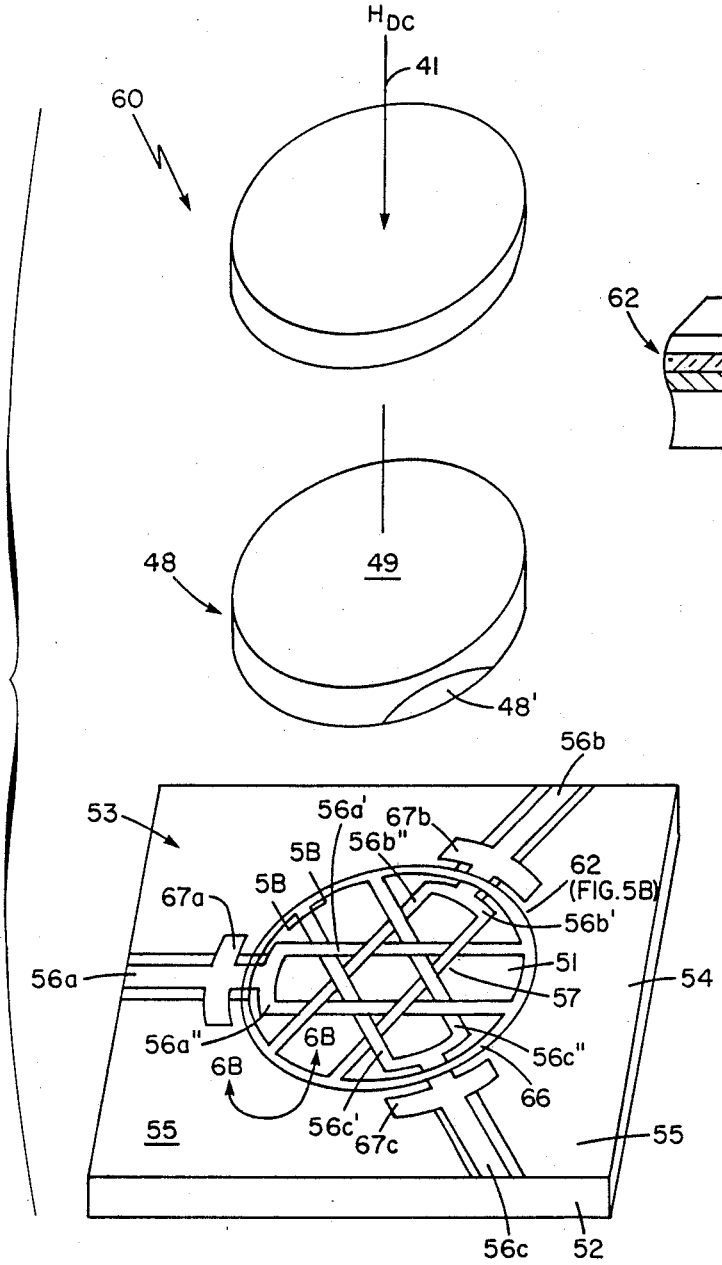
FIG. 5 is an exploded isometric view of a further alternate embodiment of a coplanar waveguide circulator having an interwoven coupling structure and a controlled node to ground capacitor.

Referring now to FIG. 5, a further alternate embodiment 60 of a coplanar waveguide miniature circulator is shown to include the substrate 52 comprised of a dielectric material having disposed thereon the coplanar waveguide transmission medium 53 with the interwoven coupling structure 55, as generally described above in conjunction with FIG. 4. Here disposed over the coupling structure 57 is the metalized ferrite disc 48 having the metal layer 49 and exposed regions for the ferrite disc 48 as also described above. Disposed over the ferrite disc 48 is a permanent magnet 41 as also described above. Here, however, a controlled node to ground capacitor 62 is provided about the periphery of the exposed, central region 51 of the substrate 52 (i.e. junction region) over which the ferrite disc 48 is disposed. The disc 48 having coating 49' as shown in FIG. 3A may alternatively be used.

Figure 5A:
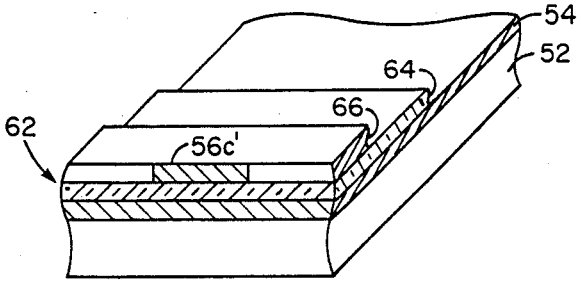
FIG. 5A is a blown-up view of a portion of the circuit shown in FIG. 5, detailing the construction of the controlled peripheral node to ground capacitance.

The controlled node to ground capacitor 62 as will be described more particularly in conjunction with FIG. 5A is used to capacitively couple the common node metalization 49 (FIG. 5) over the ferrite disc 48 to the ground plane conductor 55. The capacitance of capacitor 62 may be selected in accordance with other circulator parameters to provide optimum performance for the circulator 60. That is, the capacitor 62 is used to adjust the bandwidth over which the circulator exhibits a specified isolation, for example.

Referring now also to FIG. 5A an exemplary one of the terminal portions of strip conductor segments 56a', 56a'' to 56c', 56c'', here 56c' is shown capacitively coupled to the coplanar waveguide ground conductor 55 through the controlled, peripheral node to ground capacitor 62. The controlled, peripheral node to ground capacitance is provided by a conductive layer 66 which is disposed about the peripheral portions of the central or junction region 51 of the circulator 60 and spaced from the coplanar waveguide ground plane conductor 55 by an underlying dielectric layer 64, as shown. The strip conductor segments 56a', 56a'' to 56c', 56c'' are connected to the conductive layer 66 in regions thereof directly, opposite the strip conductors 56a to 56c, as shown for 56c'. The node to ground capacitance 62 is selected such that the phases of the three eigenvalues of the scattering matrix which defines the relationship between voltages and currents of the circulator, are separated by 120° of phase shift at the design frequency and in addition such that the frequency slopes of these phases are equal to one another.

The miniature "lumped-element" circulator as shown in FIG. 2 may be theoretically analyzed, in order to determine an optimal design. This analysis with certain modifications reflecting differences in the structures applies to the circulators shown in FIGS. 1, 4, and 5.

The circulator 20 (FIG. 2), as mentioned in the Background of the Invention Section, is fabricated by drilling a hole in a dielectric substrate and inserting a ferrite disc that has a suitable metallic coupling structure attached to it. The coupling structure illustrated in FIG. 2 consists of "interwoven" metal strips and can be fabricated by photolithography using two levels of metalization separated by a layer of insulating material. In the structure shown, each port is equivalent, i.e. the structure has perfect three-fold symmetry. Perfect symmetry is not possible without interweaving, but it has been found that simpler, non-interwoven, coupling structures give nearly the same circulator performance as the interwoven structure.

The three transmission lines shown in FIG. 2 are electrically connected to a layer of metalization on the bottom surface of the ferrite disc, which is in turn capacitively coupled to the ground plane. The value of capacitance of the capacitors 28, 29a–29c (FIG. 2) and hence capacitors 67a–67c, 62 (FIG. 5) are each selected to provide a broadband circulator response.

Figure 6:
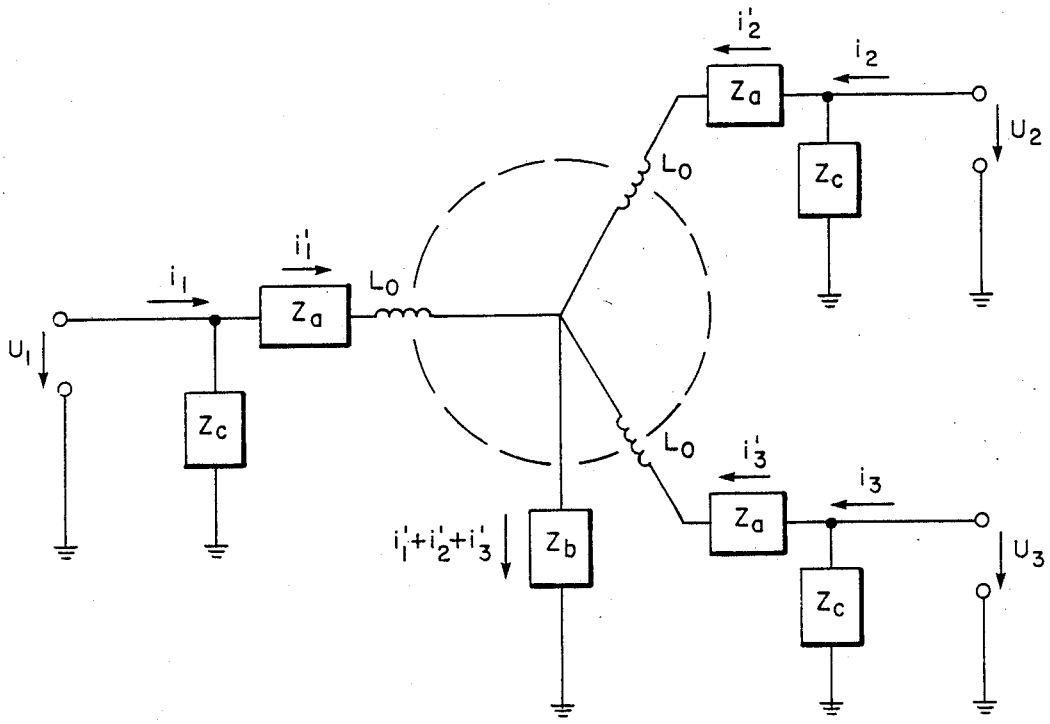
FIG. 6 is an equivalent circuit for the circulator shown in FIGS. 2, 4, and 5.

The circulator illustrated in FIG. 2 can be represented by the equivalent circuit shown in FIG. 6. Here the effect of the ferrite is only symbolically indicated by the circle, but the appropriate equations for describing the ferrite response are well known.

The mathematical analysis of the circuit shown in FIG. 6 is conveniently carried out in terms of the normal modes of the structure. The three normal modes correspond to symmetric (i.e. in-phase), right-rotating, and left-rotating excitation. It is well known that, in the lossless case, perfect circulator performance results if the phases of the eigenvalues of the scattering matrix which defines the relationship, between the currents and impedances of FIG. 6 differ from each other by 120 degrees. The broadest possible bandwidth is provided when the derivatives of the three eigenvalue phases with respect to frequency are equal to one another.

The theory of lumped element circulator design has been extended by solving the condition for perfect circulation at a given design frequency simultaneously with the condition for equal phase slope of the S-matrix eigenvalues on the basis of the general equivalent circuit illustrated in FIG. 6. When both conditions are satisfied, the three-port junction (which is assumed lossless) is a perfect circulator at the design frequency and the bandwidth is at a maximum. The resulting optimal bandwidth is largely determined by the "external" quality factor of the ferrite, which can be defined in the same manner as for YIG-filters.

It is well known (see for instance P. S. Carter, "Magnetically-Tunable Microwave Filters using Single-Crystal YIG Resonators" IRE Transactions on Microwave Theory and Techniques MTT-9, May 1961, pp. 252–260 or J. Helszajn, "YIG Resonators and Filters", Wiley, New York, N.Y. 1985, pp. 131–138) that for YIG filters the external quality factor can be represented by $$Q_{ex}=Z_o/(\mu_o\omega_m V_f K^2) \quad (1)$$

where $Z_o$ is the characteristic impedance of the transmission line, $\mu_o$ the permeability of vacuum, $\omega_m$ the magnetization frequency of the ferrite ($2\pi\cdot 5$ GHz for YIG), $V_f$ the volume of the ferrite resonator and K a coupling factor that characterizes the ratio of magnetic fieldstrength (at the site of the resonator) to current.

Figure 7:
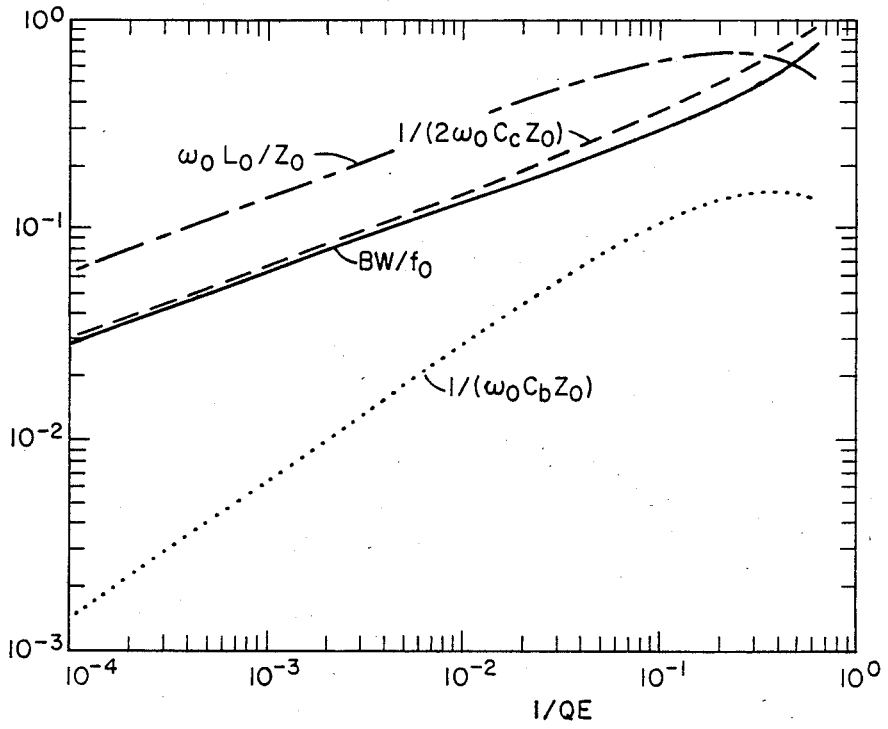
FIG. 7 is a plot of predicted circulator parameters for optimum performance for the circulators as shown in conjunction with FIGS. 2, 4, and 5.

FIG. 7 shows an example of the results obtained from the circulator model described above using extensive computer calculations. The capacitance from the junction node to ground is $C_b$, the shunt capacitance $C_c$, and the loop inductance (in the absence of ferrite) is $L_o$. FIG. 7 shows the values of reduced reactive impedance $1/(2\pi f_o C_b Z_o)$, $1/(4\pi f_o C_c Z_o)$ and $(2\pi f_o L_o/Z_o)$ required for optimization at the design frequency $f_o$ as a function of inverse external quality factor $1/Q_e$ and also shows the reduced bandwidth $BW/f_o$ (at 20 dB isolation) as a function of this parameter. The particular results summarized in FIG. 7 are based on the assumption that the series impedances $Z_a$ in FIG. 6 are replaced by short circuits ($Z_a=0$) and that the mutual inductance in the absence of ferrite is negligibly small.

For proper circulator operation, low rather than high values of $Q_{ex}$ are desirable, which represents a reversal relative to the normal usage of the term "quality". For optimal performance, the external Q of the ferrite should be low, and the "internal" or "unloaded" Q should be high.

Equations for calculating $1/Q_e$ have been derived for several cases of interest. Preliminary results show that $1/Q_e$ values as high as approximately 0.2 may be provided with relatively large pieces of ferrite. This implies a reduced bandwidth of the order of 40 percent according to FIG. 7. Decreasing the size of the ferrite disc generally decreases $1/Q_e$ and hence the circulator bandwidth.

The results of the new theoretical work can be used in the size-bandwidth trade-off in the following manner: In Equation 1 the coupling factor K is inversely proportional to the distance from the coupling strip to the center of the ferrite disc and hence to the circulator diameter. This implies that, when all dimensions are varied proportionately, $1/Q_e$ is proportional to the circulator diameter. FIG. 7 thus shows the reduced bandwidth $BW/f_o$ that can be achieved for given circulator diameter, or conversely the circulator diameter required to achieve a given bandwidth.

The magnetic fieldstrength required in the optimized miniature circulators described above is generally quite close to that for ferromagnetic resonance, especially for $Q_e >> 1$. This is in sharp contrast to conventional circulators, which are generally operated either well below or well above resonance. The near-resonance operation may require more careful control of the magnetic fieldstrength than is required in conventional circulators. It also implies that circulators based on small single crystals of magnetic materials are likely to have significantly lower losses than circulators based on polycrystals.

Figure 8:
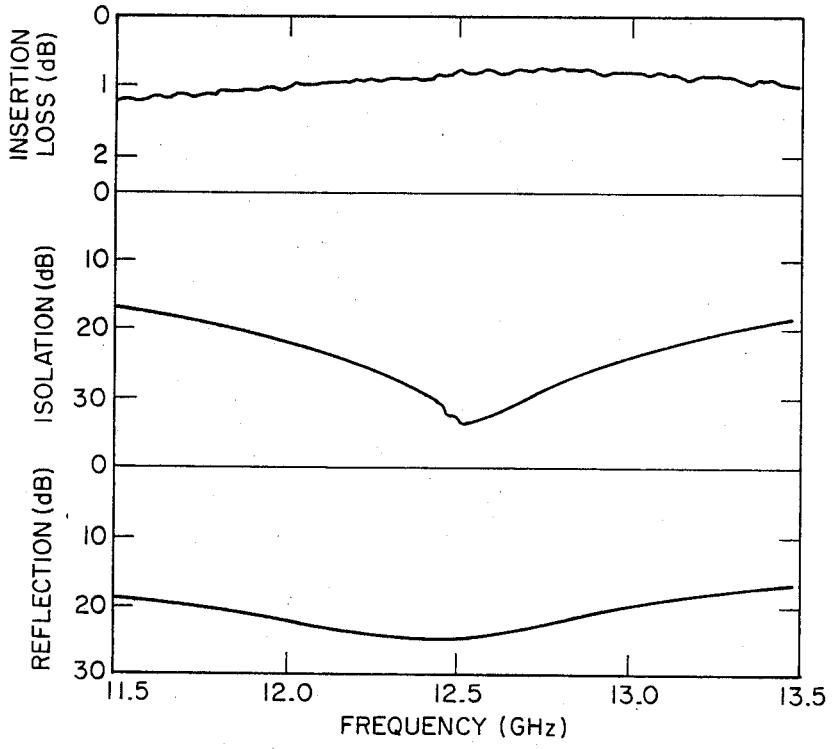
FIG. 8 is observed performance data for a coplanar circulator as described in conjunction with FIG. 3.

FIG. 8 shows actual experimental data for a circulator built in accordance with FIG. 3. Data taken for isolation, insertion loss and reflection shows a 20 dB isolating bandwidth over the range of about 11.5 GHz to 13.5 GHz. The circulator was fabricated on an 0.010 in. thick alumina substrate, with a lithium ferrite disc having a diameter of 0.16 inches and thickness of 0.01 inches.

Referring now to FIGS. 9A–11A and 9B to 11B, a preferred technique for forming an interwoven coupling structure disposed on a dielectric substrate for use with the circulator as shown in conjunction with FIG. 4 will now be described.

Figure 9B:
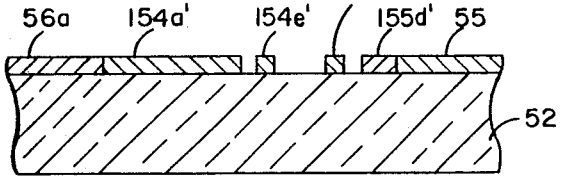
Figure 9A:
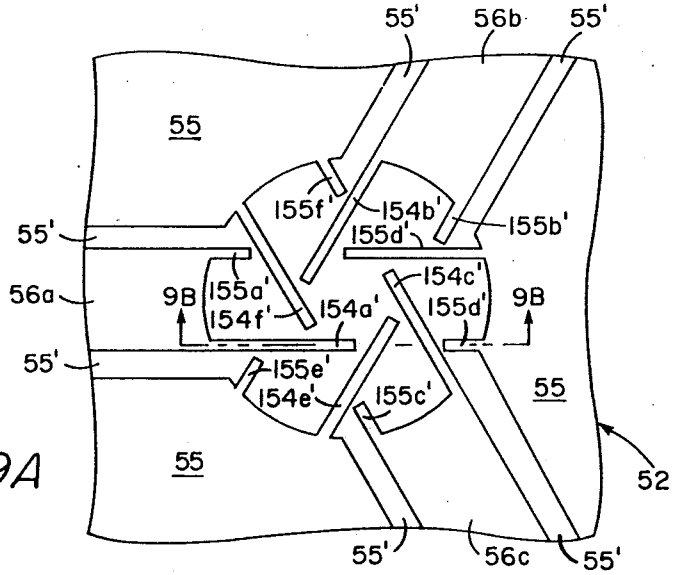

Referring first to FIGS. 9A and 9B, a first layer of metal (not numbered) is disposed over the substrate 52 and is patterned to provide a ground plane conductor 55 and spaced strip conductor portions 56*a*–56*c*, spaced by channels 55' as generally described in conjunction with FIG. 4. Here also disposed on the substrate is a plurality of here twelve patterned strip conductor segments 154*a*'–154*f*' and 155*a*'–155*f*'. Here strip conductor segments 154*a*'–154*f*' are relatively long strip conductors whereas the segments 155*a*'–155*f*' are relatively short strip conductor segments. Here strip conductor segments 154*a*', 154*b*', and 154*c*' have a first end connected to corresponding strip conductors 56*a*–56*c* and strip conductor segments 154*d*'–154*f*' have ends connected to the ground plane conductor 55 as shown. Similarly, strip conductor segments 155*a*'–155*c*' have first ends connected to corresponding strip conductors 56*a*–56*c* as shown, with said strip conductors being disposed opposite corresponding long strip conductor 154*d*'–154*f*' as shown, and segments 155*d*'–155*f*' have a first end terminated in the ground plane conductor 54 and are disposed opposite corresponding sections 154*a*'–154*c*' as also shown.

Figure 10B:
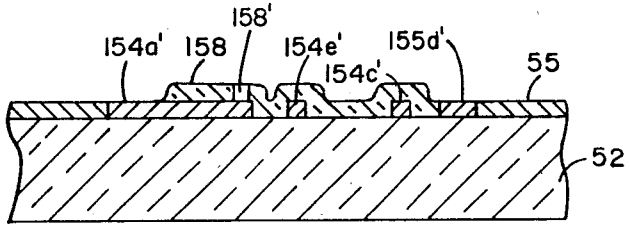
Figure 10A:
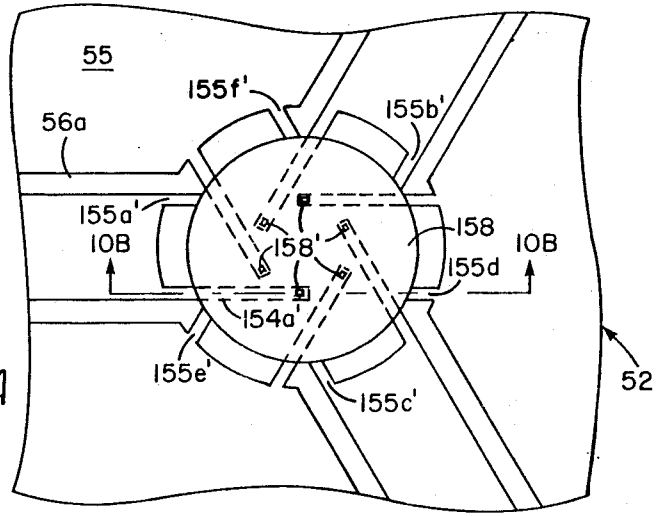

Referring now to FIGS. 10A and 10B, a patterned layer of dielectric 158 is shown disposed over the plurality of strip conductor segments 154*a*'–154*f*' and 155*a*'–155*f*' (FIG. 9A). Here the dielectric layer 158 is patterned to have a substantially circular shape and is further patterned such that substantial major portions of the small strip conductor portions 155*a*'–155*f*' are exposed over the dielectric substrate 52 and terminated at the edge for the dielectric layer 158 as shown. Portions of the long strip conductor segments 154*a*'–154*f*' (referenced in FIG. 9A) are substantially masked by the dielectric layer 158. A plurality of apertures 158', here six of such apertures are provided in the dielectric layer 158, with said apertures 158*a* exposing underlying end portions of the long strip conductors 154*a*'–154*f*' (referenced in FIG. 9A) as also shown. These apertures 158' are used to make electrical interconnection for the second metalization layer as will now be described in conjunction with FIG. 11A.

Figure 11B:
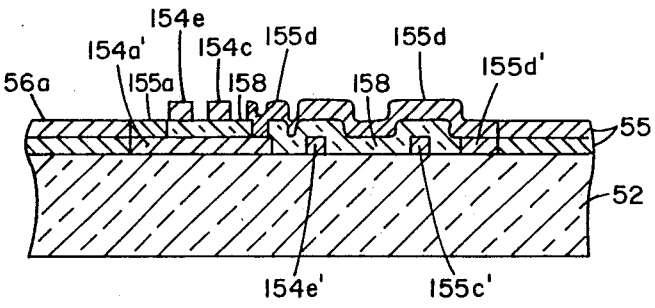
Figure 11A:
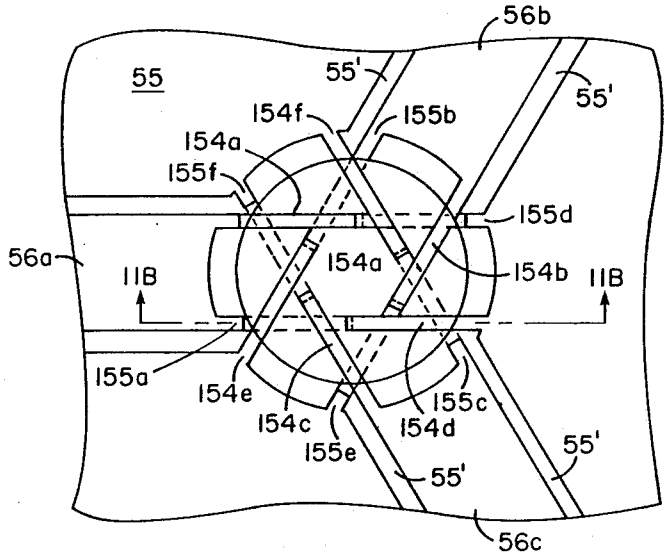

Referring now to FIGS. 11A and 11B, a second layer of metalization is here shown disposed over the substrate 52 and dielectric layer 158. Here the second layer of metalization includes strip conductor segments 154*a*–154*f* and 155*a*–155*f*, such segments being disposed over corresponding underlying portions of the first metalization layer of strip conductor segments 154*a*'–154*f*' and 155*a*' to 155*f*' (FIG. 9A) described in conjunction with FIG. 9A. That is, the relatively long upper metalization portions 154*a*–154*f* are disposed over the relatively short underlying portions 155*a*'–155*f*', whereas the relatively short upper metalization portions 155*a*–155*f* are disposed over the relatively long underlying metalization portions 154*a*'–154*f*'. The second or upper layer of metalization is further disposed such that the long branches of the second layer of metalization make contact with the underlying short branches of the first layer of metalization. With this arrangement, an interwoven coupling structure disposed on the substrate 52 having only six interconnects between the upper layer of metalization and the lower layer of metalization is provided. This coupling structure may be in some aspects easier to fabricate than the structure generally described in conjunction with FIG. 4A.

Figure 12:
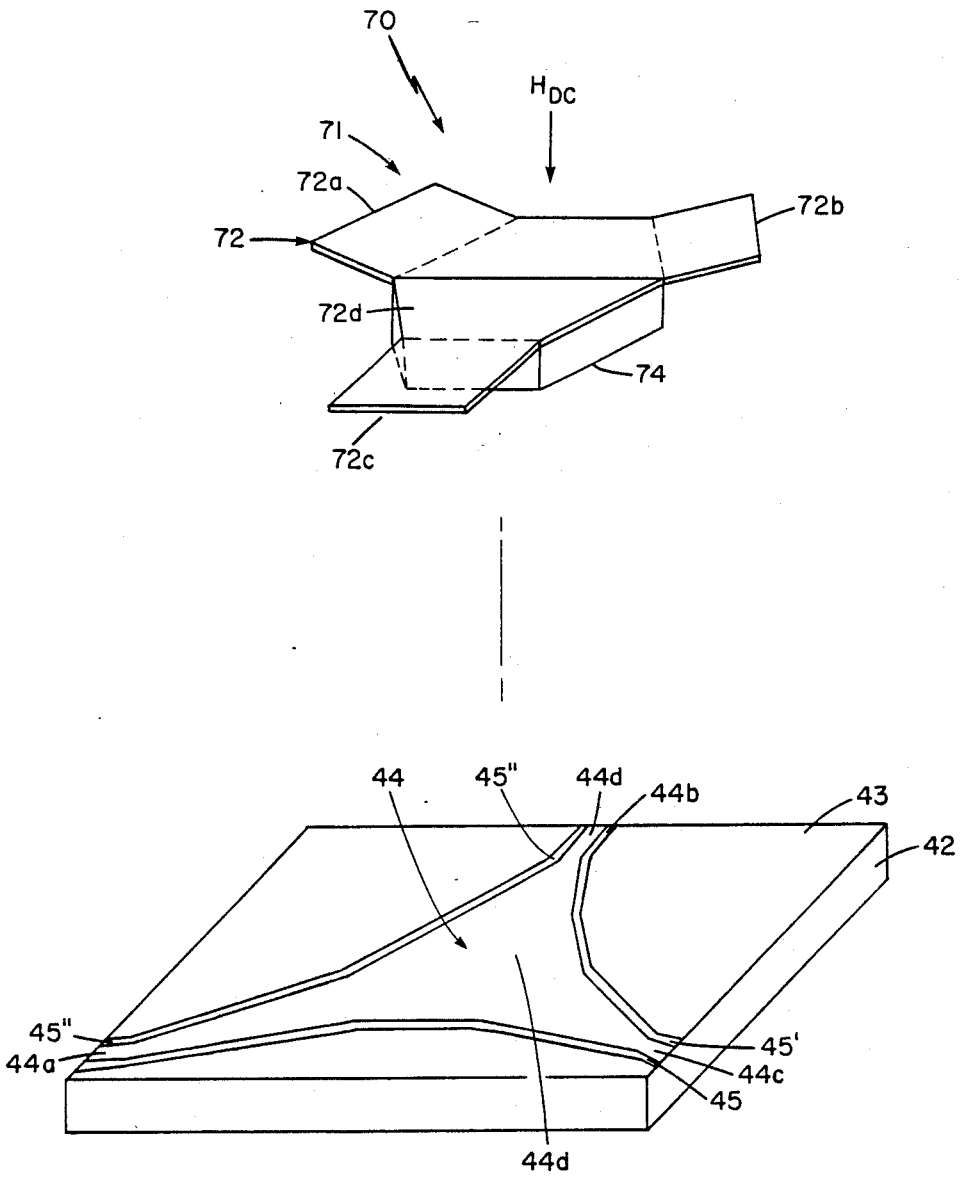
FIG. 12 is an isometric view of an alternate embodiment of the present invention.

Referring now to FIG. 12, an alternate embodiment of a coplanar waveguide circulator is shown to include a substrate 42 having disposed over a first surface thereof a ground plane conductor 43. A patterned conductor 44 is disposed on a central exposed region of said substrate (i.e. not covered by the ground plane conductor 43) and spaced from said ground plane conductor 43 by channels 45, 45', and 45'', as shown. The conductor 44 has branch portions 44*a*–44*c* and a central portion 44*d*. The circulator 70 is shown to further include a circulator element 71. Circulator element 71 here includes a ferrite substrate 74 here a disc having a substantially hexangular shape and a patterned node metalization 72 disposed over an upper surface thereof, said node metalization having beam lead portions 72*a*–72*c* and central node portions 72*d*. The circulator element 72 is thus disposed over the substrate 42 such that the patterned beam leads 72*a*–72*c* are bonded to the ground plane conductor 43. With this particular arrangement, a substantially simple coupling structure is provided. The ferrite disc having a hexangular shape may be more easily provided from a large substrate of ferrite than a circular disc.

Figure 13:
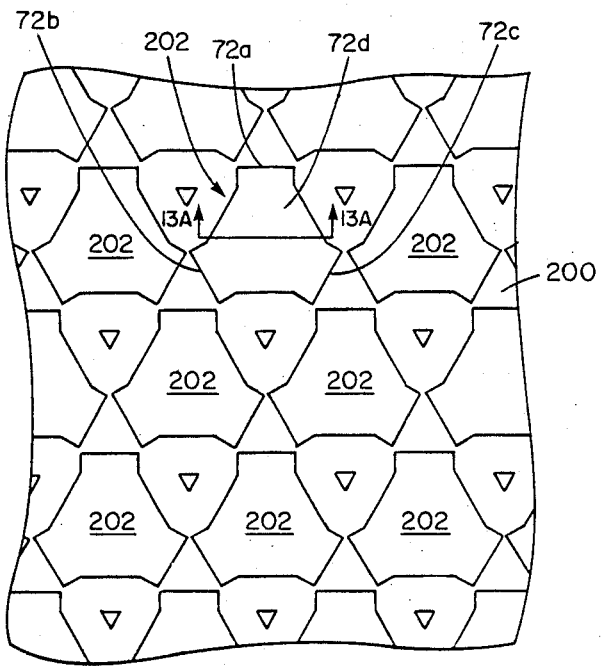
FIG. 13 is a plan view of a ferrite substrate carrying a plurality of coupling structures of the embodiment of FIG. 12.
Figure 13A:
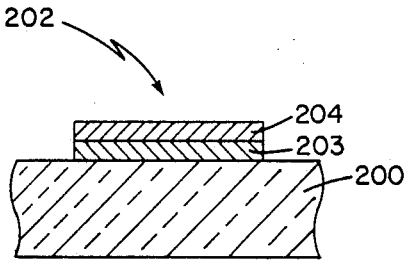
FIGS. 13A and 14A are cross-sectional views taken along lines 13A—13A of FIG. 13 and 14A—14A of FIG. 14 respectively.

A preferred technique for providing the circulator element 70 will be described in conjunction with FIGS. 13, 13A, 14, and 14A. Referring to FIGS. 13, 13A a large area ferrite substrate 200 is shown having disposed over a first surface thereof pattern metalization layers 202, said metalization layers being patterned to provide a substantially central portion 72*d* having a hexangular shape with branched portions 72*a*–72*c*, as shown. Said metalization layer includes an adherent layer (203) and a conductive layer (204). A suitable material for the adherent layer is titanium and for the conductive layer is gold. The titanium layer i.e. adherent layer 203 is patterned to be present only over the central hexangular shaped areas 72*d* and not the branch areas 72*a*–72*c*. The gold, conductive layer 204 will in general not adhere to the ferrite 200. Thus, this technique can be used to provide beam-lead structures, as will be described in conjunction with FIG. 14. Alternatively, photoresist patches (not shown) may be disposed under the branched portions 72*a*–72*c* prior to metalization of the top surface of the ferrite 200. The said photoresist patches also may be used to provide the beam leads for the structure as generally known in the semiconductor art.

Figure 14:
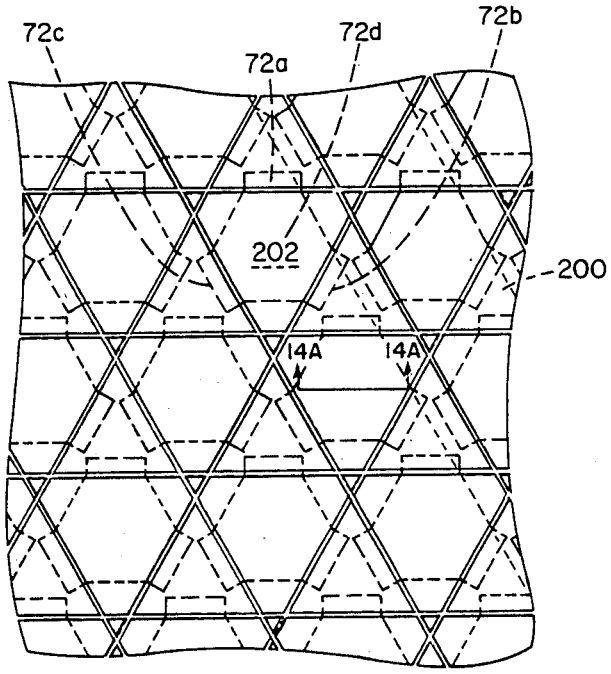
FIG. 14 is a plan view of the substrate of FIG. 13 being cut from the frontside of the substrate into individual coupling structures having hexangular shaped ferrite discs.
Figure 14A:
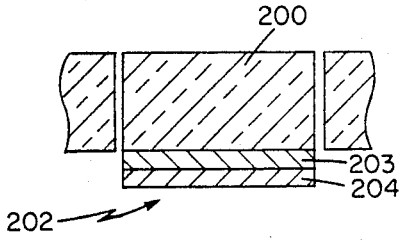

Referring to FIGS. 14, 14A the ferrite substrate is turned over and by using well defined backside alignment marks (not shown) referenced to a well defined right angle corner of the substrate a precise depth control diamond saw is used to cut the substrate 200 into a plurality of beam leaded hexangularly shaped ferrite discs to provide circulator element 70. Alternatively, the photoresist layers (not shown) are dissolved from underneath the beam leads 72*a*–72*c*, and the beam leads are folded up out of the way (not shown) here over the central hexangular shaped portions 72*d*. The substrate 200 is then cut into a plurality of triangles and hexagons by use of a diamond saw as known in the semiconductor art.

Having described preferred embodiments of the invention, it will now become apparent to one of skill in the art that other embodiments incorporating their concepts may be used. It is felt, therefore, that these embodiments should not be limited to disclosed embodiments, but rather should be limited only to by the spirit and scope of the appended claims.

What is claimed is:

1. A non-reciprocal microwave device responsive to a DC magnetic field and having at least a pair of ports, comprising:
   - a dielectric substrate;
   - a ground plane conductor disposed on a first surface of said substrate;
   - a patterned strip conductor disposed on said first surface of said substrate, dielectrically isolated from said ground plane conductor, with said patterned strip conductor having a common central portion and at least two strip conductor portions, each one having a first end respectively connected to the common central portion and a second end which provides port connections for the circulator;
   - a ferrite body, through which said DC field is applied, disposed over said common central portion of said patterned strip conductor; and
   - a conductive layer disposed around said ferrite body except in regions of said body which come into contact with said strip conductor portions.

2. The device of claim 1 further comprising:
   - means for providing a D.C. magnetic field through said ferrite body to bias said ferrite body near ferromagnetic resonance.

3. The device of claim 2 wherein:
   - said dielectric substrate is semi-insulating gallium arsenide.

4. The device of claim 3 wherein said ferrite is substantially circular in shape.

5. The device of claim 3 wherein said ferrite body is substantially hexangular in shape.

6. The device of claim 4 wherein said ferrite is selected from the group consisting of the garnets and the spinel ferrites.

7. The device of claim 5 wherein said ferrite is selected from the group consisting of yttrium iron garnet and Li ferrite.

8. A microwave circulator responsive to a DC magnetic field comprising:
   - a dielectric substrate;
   - a patterned ground plane conductor disposed on a first surface of said substrate;
   - an interwoven coupling circuit disposed on said surface of said substrate and dielectrically isolated from said ground plane conductor, said interwoven coupling circuit including at least three pairs of bifurcated strip conductors, each pair having first ends coupled to a port of the circulator and second ends coupled to said ground plane conductor with each one of said bifurcated strip conductor portions being interwoven with each of the other two pairs of bifurcated strip conductor portions; and
   - a ferrite body, through which said DC field is applied, disposed over said interwoven coupling structure.

9. The microwave circulator as recited in claim 8 further comprising:
   - means for providing a D.C. magnetic field through the ferrite body to bias said body substantially near ferromagnetic resonance.

10. The circulator of claim 9 wherein said ferrite body is a disc.

11. The device of claim 10 wherein said ferrite is selected from the group consisting of the garnets and the lithium ferrites.

12. The device of claim 10 wherein said ferrite is selected from the group consisting of yttrium iron garnet and Li ferrite.

13. The circulator of claim 8 wherein said substrate is selected from the group of material consisting of $Al_2O_3$ and GaAs.

14. The circulator of claim 8 wherein said ferrite body is a disc and includes a layer of metal disposed over a first surface thereof and said circulator further comprises means for coupling said layer of metal to said ground plane conductor.

15. The circulator of claim 8 wherein said ferrite is a hexangular shaped disc.

16. The device of claim 15 wherein said ferrite is selected from the group consisting of yttrium iron garnet and Li ferrite.

17. A microwave circulator responsive to a DC magnetic field comprising:

a dielectric substrate;

a patterned ground plane conductor disposed on a first surface of said substrate;

an interwoven coupling circuit disposed on said first surface of said substrate and dielectrically isolated from said ground plane conductor, said interwoven coupling circuit including at least three strip conductors each having a first end coupled to a port of the circulator and a second end coupled to a pair of bifurcated strip conductor portions, with each one of said bifurcated strip conductor portions being interwoven with each one of the bifurcated pair of strip conductor portions of the other two strip conductors;

a ferrite body, through which said DC field is applied, disposed over said interwoven coupling structure; and means for capacitively coupling end portions of said interwoven coupling circuit to said ground plane conductor, said means disposed about the periphery of said coupling circuit.

18. The microwave circulator as recited in claim 17 further comprising:

means for providing a D.C. magnetic field through the ferrite body.

19. The microwave circulator of claim 18 wherein said spaced strip conductor portions are coupled to the ground plane conductor by the means for providing capacitive coupling.

20. A microwave circulator responsive to a DC magnetic field comprising:

a dielectric substrate;

a patterned ground plane conductor disposed over a first surface of said substrate, patterned to provide an exposed central portion of said substrate and exposed branched portions;

a patterned strip conductor disposed over said first surface in said patterned central portion and branched portions and dielectrically spaced from said ground plane conductor;

a ferrite disc, through which said DC field is applied, having a substantially hexangular shape, having a first major surface disposed on said patterned conductor; and means including a conductive layer disposed over a second major surface of said ferrite disc, for providing electrical contact between said conductive layer and said ground plane.

* * * * *